US006221230B1

(12) United States Patent
Takeuchi et al.

(10) Patent No.: US 6,221,230 B1
(45) **Date of Patent: *Apr. 24, 2001**

(54) PLATING METHOD AND APPARATUS

(76) Inventors: Hiromitsu Takeuchi, 74, Inokuchi Otsubo-cho, Inazawa-shi, Aichi-ken 492-8164 (JP); Masahiro Okumiya, 3785-3391, Shimadakuroishi, Tempaku-ku, Nagoya-shi, Aichi-ken 468-0027 (JP); Yoshiki Tsunekawa, 2-5-8, Tatsumiminami, Okazaki-shi, Aichi-ken 444-0874 (JP); Yutaka Kawai, 2-36, Hachiken-cho, Kariya-shi, Aichi-ken 448-0021 (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/078,572

(22) Filed: May 14, 1998

(30) Foreign Application Priority Data

May 15, 1997 (JP) ..... 9-125976
May 15, 1997 (JP) ..... 9-125977

(51) Int. Cl.[7] ..... C25D 5/08
(52) U.S. Cl. ..... 205/133; 204/275.1
(58) Field of Search ..... 205/133, 109, 205/118; 204/242, 279, 275.1, 620

(56) References Cited

U.S. PATENT DOCUMENTS

| | | | | |
|---|---|---|---|---|
| 3,810,829 | | 5/1974 | Fletcher . | |
| 4,367,123 | | 1/1983 | Beck . | |
| 5,641,391 | * | 6/1997 | Hunter et al. | 205/80 |
| 5,651,872 | * | 7/1997 | Takeuchi et al. | 205/109 |
| 5,830,334 | * | 11/1998 | Kobayashi | 204/224 |

FOREIGN PATENT DOCUMENTS

| | | | |
|---|---|---|---|
| 44 42 961 A1 | | 6/1996 | (DE) . |
| 06088284 | * | 9/1992 | (JP) . |
| 8104997A | | 4/1996 | (JP) . |

* cited by examiner

*Primary Examiner*—Kathryn Gorgos
*Assistant Examiner*—Erica Smith Hicks

(57) ABSTRACT

A method and apparatus for forming a layer of plating on a base material and a method for manufacturing a three dimensional object. The plating apparatus includes a nozzle for delivering a stream of plating fluid and an electric source for applying a voltage between the base material and the nozzle. The nozzle has an outer wall and a stem located at its center. The nozzle delivers plating fluid from the opening of the nozzle in an annular manner to produce a stream that has a substantially uniform flow velocity when the stream hits the base material. In an another embodiment, the nozzle has surrounding conduit for conducting air. The air increases the velocity of a peripheral portion of the stream. To manufacture a three dimensional object, a plating layer is deposited, and the nozzle is moved to form a desired shape while piling the layer.

15 Claims, 7 Drawing Sheets

Fig.11 (a)
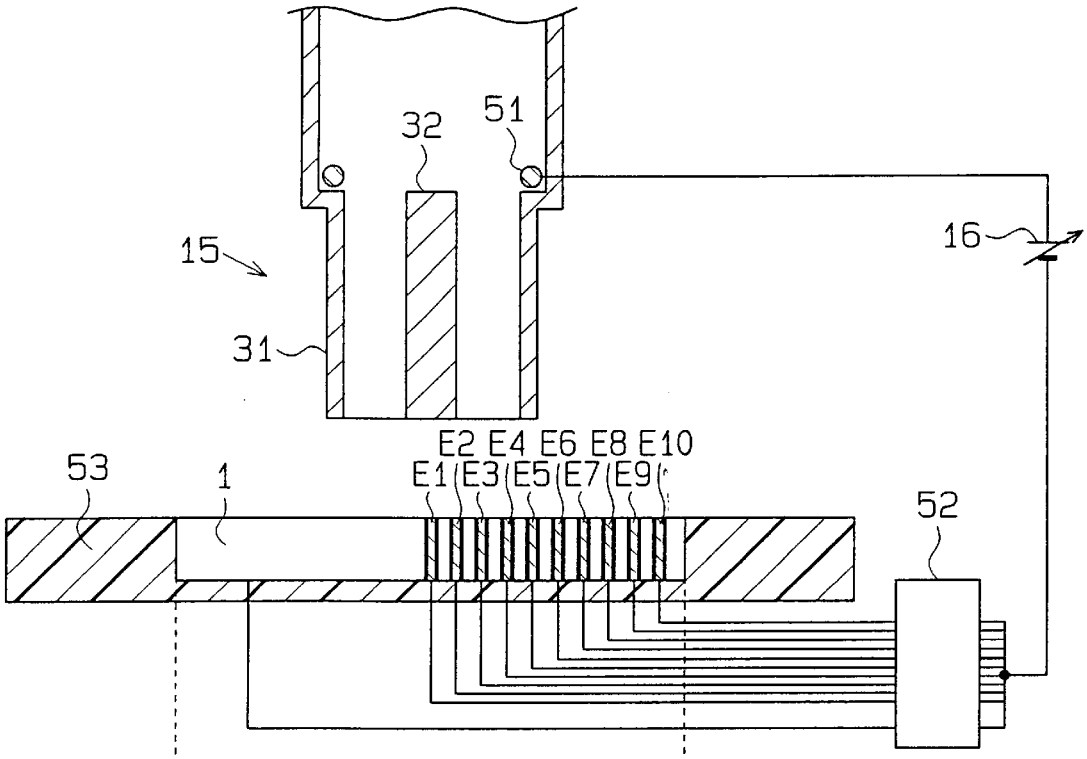
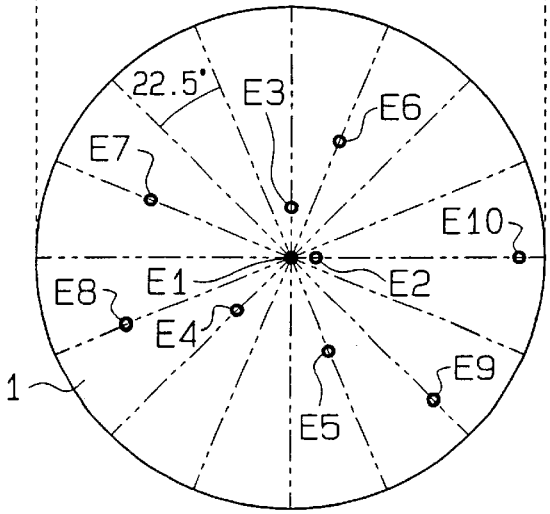
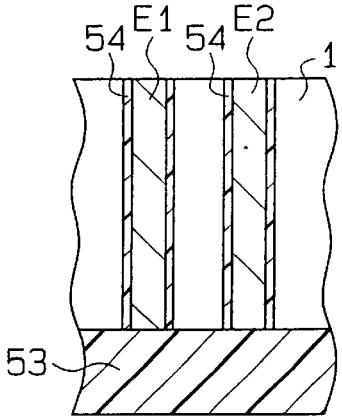
Fig.11 (b)
Fig.11 (c)

PLATING METHOD AND APPARATUS

BACKGROUND OF THE INVENTION

1. Field of Invention

The present invention relates to a plating method and apparatus for conductive metal base materials, and a method for manufacturing three-dimensional metal objects.

2. Brief Description of the Related Art

Various types of products using plated metal base materials such as iron and aluminum exist. For example, bumpers for automobiles, rearview mirrors, reflectors, electric and electronic parts, precision instrument parts, aircraft components, engine pistons, bus bars, and electrical wires are included in such products.

Generally, plating a metal base material such as aluminum includes a pretreating stage and a plating stage. In the pretreating stage, oxide film and dirt are removed from the surface of the base material to ensure adhesion between the base material and plated layer. A zincate process is employed for the pretreating stage. The zincate process includes a degreasing step, an etching step, an acid wash step, and a zinc displacement step, all of which are performed on the surface of the base material.

In the degreasing step, the surface of the base material is degreased. In the etching step, the surface of the aluminum base material is eroded by an etching solution. In the acid wash step, the surface of the aluminum is eroded by an acid such as nitric acid, hydrofluoric acid, or sulfuric acid. In the zinc displacement step (or zinc alloy displacement), the aluminum base material is exposed to a zinc displacement solution, which has basic ingredients of sodium hydride and zinc oxide. Consequently, a thin oxide film on the aluminum is removed, and zinc is separated and displaced on the newly exposed labile surface of the aluminum base material. As a result, zinc film covers the surface of the aluminum base material. If the zinc displacement process is repeated after the zinc film has been removed, the surface of the base material is made much more even.

After the complex pretreating stage, the base material is electroplated, which is commonly known. At the plating stage, the base material is immersed in a predetermined plating solution and a voltage is applied between electrodes. This forms an electroplated layer on the surface of the base material.

However, in the above plating method, the pretreating stage increases costs. It is also difficult to form a plated layer specifically on a limited surface area of the base material by the above method. When only the limited surface is to be plated, the rest of the surface is masked with insulating tape or other coating to expose only the limited area. The masking process further reduces efficiency.

Japanese Unexamined Patent Publication No. 8-104997 proposes a solution to this problem. According to the publication, plating fluid is squirted through a nozzle opening on the surface of the base material. Simultaneously, a plated layer is formed on any specified surface area of the base material by applying a voltage between the nozzle and the base material, which are electrically connected to each other by the plating fluid.

However, using this prior art method, it is difficult to form a plated layer with an even surface. Since the distal end of the nozzle has a cylindrical shape, the plating fluid is squirted through a circular opening. The flow velocity of plating fluid squirted from the nozzle is higher at the central region and lower in the region closer to the periphery. The resulting plated layer is formed with a thickness in accordance with the flow velocity of the plating fluid colliding against the surface of a base material. Therefore, the thickness of the plating layer is thicker at the central region and thinner in the region near the periphery.

Three-dimensional objects such as molds and dies are formed into a desirable shape by cutting or electron discharge. At the final stage, the formed products are ground by human hands. Ornaments such as bronze statues are formed by die casting, and the formed products are also ground.

However, these manufacturing methods are complicated and inefficient. The electron discharge method requires a large, expensive equipment. In these methods, final products are obtained by cutting off the base material, and the cut off base material is wasted.

When molds have relief areas, or the formed products have hollow shapes, die casting becomes difficult. In this case, many partial molds and slide cores are necessary. This complicates the molds and increases the manufacturing costs.

SUMMARY OF THE INVENTION

To achieve the above objective, the present invention provides a plating method comprising the steps of: providing a conductive base material; depositing a stream of plating fluid from a nozzle positioned over the base material such that the flow velocity of the plating fluid is substantially uniform across the stream when the plating fluid hits the base material; and applying a voltage between the nozzle and the base material to form a layer of plating on the surface of the base material.

A further aspect of the present invention further provides an apparatus for forming a layer of plating on a conductive base material, the plating apparatus comprising: a nozzle positioned over the base material for depositing a stream of plating fluid on the base material; a voltage source for applying a voltage between the base material and the nozzle; and means for producing a substantially uniform flow velocity across the stream when the plating fluid hits the base material.

Another aspect of the present invention provides a method for manufacturing a three dimensional object, the method comprising the steps of: providing a conducive base material; depositing a stream of plating fluid from a nozzle positioned over the base material at a controlled flow velocity; forming a layer of plating on the surface of the base material by applying a voltage between the nozzle and the base material; and forming a three dimensional object with a desired shape by controlling the movement of the nozzle with respect to the base material while piling the layer.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 11(*a*) is a schematic sectional view showing a system for measuring electric current density;

FIG. 11(*b*) is a plan view showing the base material of FIG. 11(*a*); and FIG. 11(*c*) is a partial, enlarged sectional view showing the electrodes of FIG. 11(*a*).

DETAILED DESCRIPTION OF THE PREFERRED EMBODIMENTS

Figure 1:
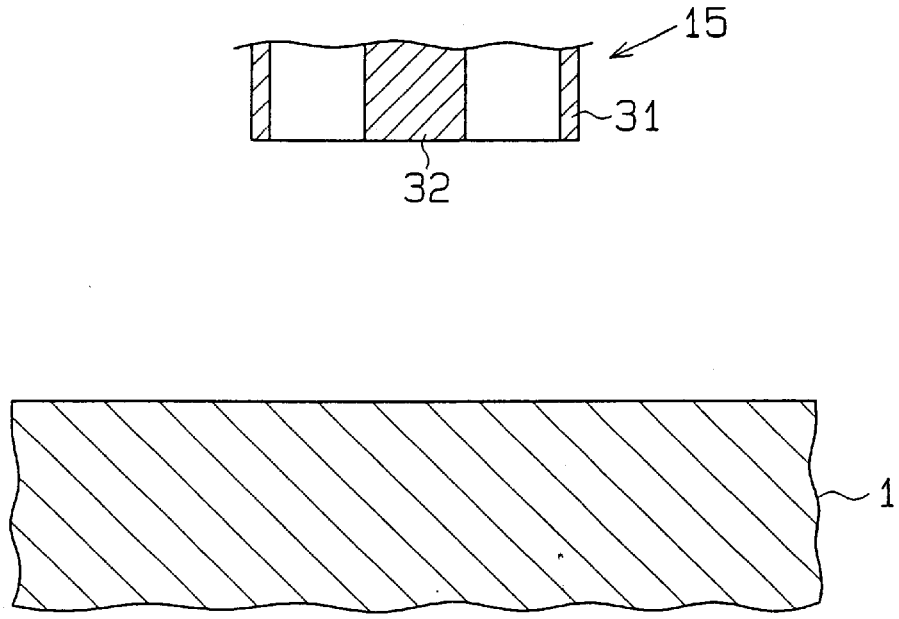
FIG. 1 is a partial sectional view showing a base material and a jet nozzle of a plating apparatus in a first embodiment according to the present invention.

In the drawings, like numerals are used to designate like elements throughout.

First Embodiment

Figure 2:
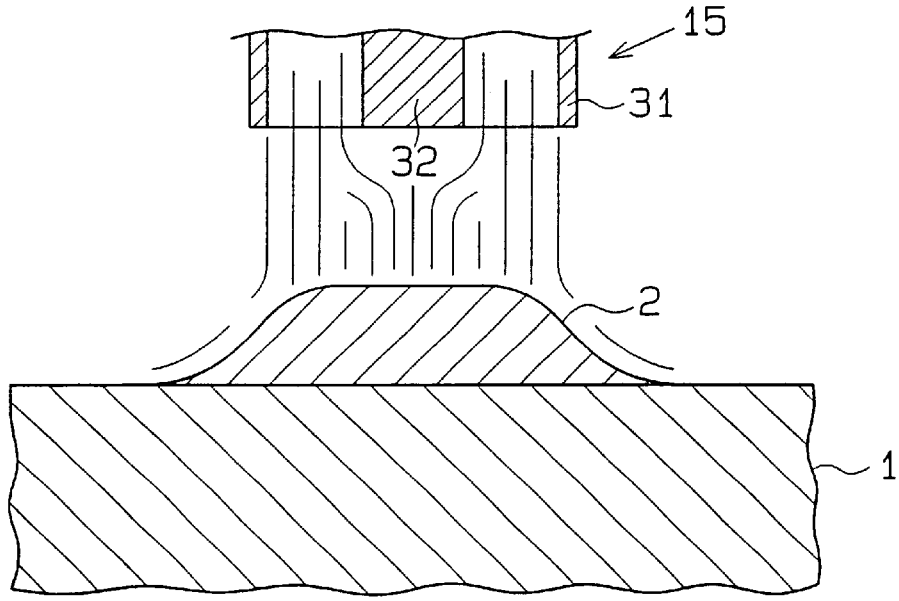
FIG. 2 is a partial sectional view showing a base material, a plated surface layer, and a jet nozzle.
Figure 3:
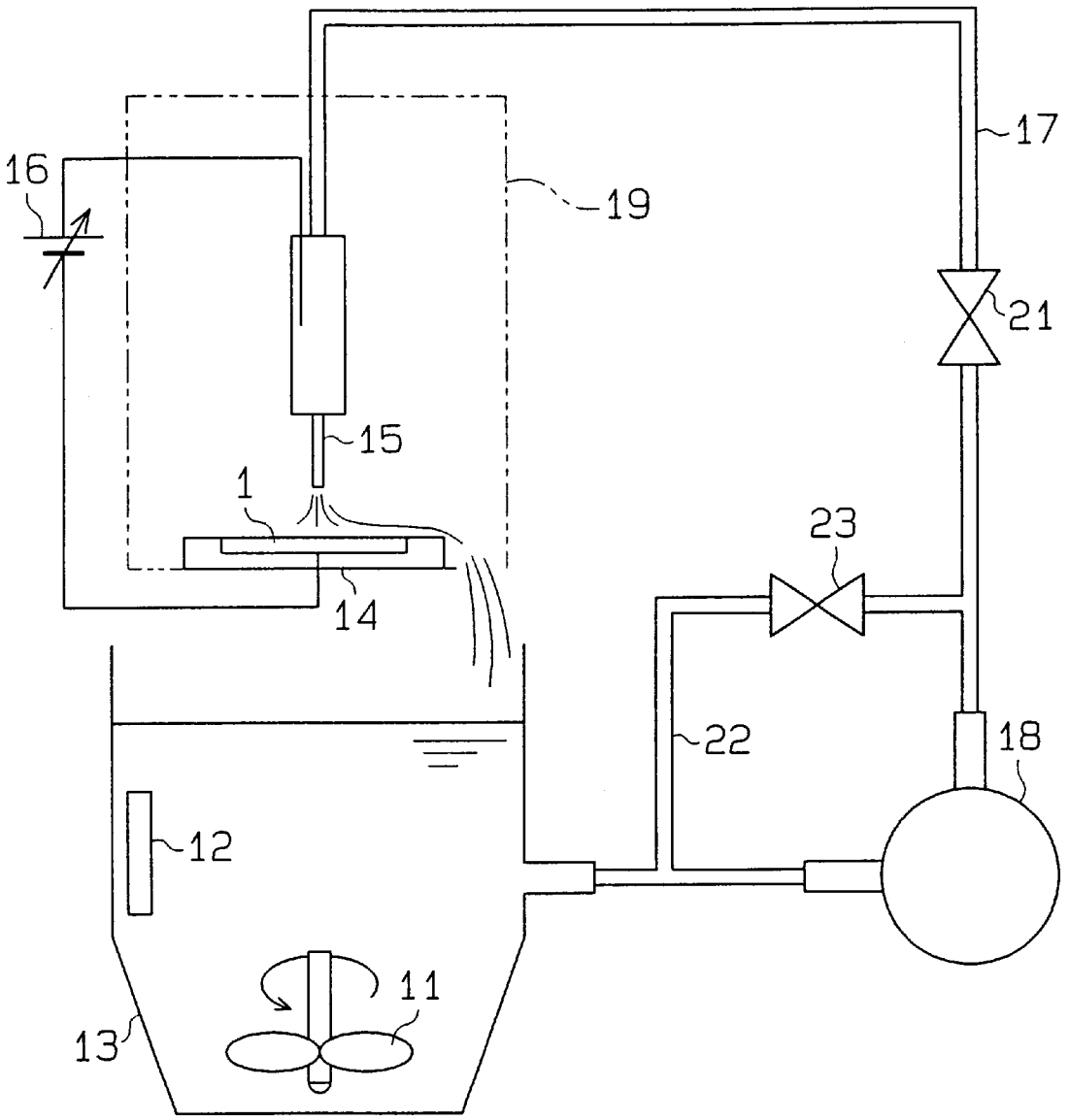
FIG. 3 is a schematic system diagram of the plating apparatus.

A plating method and apparatus according to a first embodiment of the present invention will now be described in reference to FIGS. 1 to 5. As shown in FIG. 2, the plating method is used for forming a plated layer 2, preferably made of nickel, by squirting plating fluid on a metal base material 1, preferably made of aluminum (simply called "base material" hereafter). As shown in FIG. 3, the plating apparatus includes a tank 13 containing plating fluid, a pump 18 for pumping the plating fluid from the tank 13, and a jet nozzle 15 for squirting the plating fluid on the base material 1.

The tank 13 accommodates a stirrer 11 for stirring the plating fluid and a heater 12 for heating the plating fluid. A stage 14 is provided above the tank 13 to position the base material 1. The jet nozzle 15 is provided above the stage 14. A power source 16 has an anode connected to the jet nozzle 15 and a cathode connected to the stage 14.

A passage 17 connects the tank 13 and the jet nozzle 15 by way of the pump 18. The pump 18 sends the plating fluid, which has been heated and stirred evenly, to the jet nozzle 15 through the passage 17. The jet nozzle 15 squirts, or deposits, the plating fluid in a stream towards the surface of base material 1. A box 19 surrounds the stage 14 and the jet nozzle 15 to prevent the plating fluid from scattering.

A main valve 21 is provided in the passage 17 between the pump 18 and the nozzle 15. The amount of plating fluid delivered is adjusted by controlling the opening of the valve 21. A bypass 22 joins the upstream and downstream sides of the pump 18. A sub valve 23 is provided in the bypass 22. The amount of plating fluid returning from the downstream side of the pump 18 is adjusted by controlling the opening of the valve 23, and this also adjusts the amount of the plating fluid delivered from the nozzle 15.

As shown in FIG. 1, the distal end of the jet nozzle 15 has a tube, or cylindrical wall 31, and a centrally located stem 32. Accordingly, the nozzle 15 has an annular opening. The plating fluid is not delivered from the central region of the nozzle 15, that is, from the location of the stem 32. The internal diameter of the cylinder 31 is 4.5 mm, and the diameter of the stem 32 is 5.0 mm. (These are exemplary values.) The plating fluid used is preferably composed of nickel sulfamate "$Ni(NH_2SO_4).4H_2O$" (430 kg/m$^3$), nickel chloride "$NICl_2.GH_2O$" (15 kg/m$^3$), boric acid ($H_2BO_3$) (45 kg/m$^3$), saccharin "$C_7H_5NO_3S$" (5 kg/m$^3$). Nickel plating fluid, copper plating fluid, zinc plating fluid, tin plating fluid, a combination of these fluids, or a plating fluid containing any metal ions may be used as the plating fluid.

A plating method to form a plated layer 2 with the above apparatus will now be explained. A base material 1, which has been pretreated as described in the prior art, is placed on the stage 14. The distance between the base material 1 and the distal end of nozzle 15 is set, for example, at 5 mm. Then the power source 16 is turned on to operate the pump 18. The openings of the sub valve 23 and the main valve 21 are adjusted accordingly.

The plating fluid is sent through the passage 17 and deposited from the nozzle 15 to the surface of the base material 1. The stream of plating fluid has a relatively high flow velocity. The flow velocity is preferably 1.0 m/s or higher, more preferably 4.0 m/s or higher, much more preferably 10 m/s or higher, and still more preferably 12 m/s or higher. However, there is an upper limit on the flow velocity. At a certain flow velocity, the base material will be deformed.

The plating fluid squirted from the jet nozzle 15 connects the nozzle 15 and the base material 1 electrically. The jet nozzle serves as an anode, and the base material 1 serves as a cathode. The metal ion ingredient (nickel) in the plating fluid is separated as a metal matrix on the surface of the base material 1 by the applied voltage, and this forms a plated layer 2 (shown in FIG. 2).

Accordingly, unlike the conventional plating method of immersing a base material, a firm plated layer 2 is formed on the base material 1 with a simple process of depositing a stream of metal plating fluid on the base material 1 with a predetermined flow velocity. This simplifies the equipment and lowers the cost.

In this embodiment, since there is no need for masking, the plated layer is easily formed on the specified surface area of the base material 1. In other words, by adjusting the position of either the base material 1 or the jet nozzle 15, the plated layer 2 is formed on any desired surface location of the base material 1. This dramatically improves efficiency.

In this embodiment, the flow velocity of the plating fluid stream is substantially equal between the center and the periphery of the plating area because the plating fluid does not issue from the stem 32. When a conventional, stemless nozzle is used, the flow velocity is highest at the center. However, the flow velocity in the central region of the nozzle is decreased in this embodiment. Therefore, the flow velocity of the stream as it strikes the surface of a base material 1 is nearly uniform across the stream. Therefore, the thickness of the plated layer 2 is also substantially uniform.

(Confirmation Experiment)

The inventors have performed the following two experiments to confirm uniformity of a plated layer.

First Experiment: The distribution of the current density i was measured when platinum base material (cathode) was plated. Then, a comparison was made between a plating apparatus with the improved jet nozzle 15 and a plating apparatus with a conventional nozzle (without a stem in its center).

A method for measuring current density will be explained referring to FIGS. 11(*a*) to 11(*c*). As shown in FIG. 11(*a*), the bottom surface and peripheral surface of the base material 1 is coated by a coating 53 made of epoxy resin. Electrodes E1 to E10 are embedded in the base material 1. The electrodes E1 to E10 are made of copper wires with a diameter of about 0.8 mm. The electrodes E1 to E10 are connected to an ammeter 52, respectively. To insulate the base material 1 and the electrodes E1 to E10 from each other, the electrodes E1 to E10 are coated with an insulation 54 made of epoxy resin (shown in FIG. 11(*c*)).

The electrode E1 is located at the center of the circular base material 1 under the stem 32. The other electrodes E2 to E10 are located at certain radial positions, which are spaced apart by equal intervals. For example, if E2 is a distance 'd' from the center, then E3 is a distance of 2*d* from the center and E4 is a distance of 3*d* from the center and so on. Actually, the electrodes E1 to E10 are arranged on radial lines at various angular positions, as shown in FIG. 11(*a*). In FIG. 11(*a*), however, the electrodes E1 to E10 are illustrated as if they lie on the same radial line to show the distances from the center to each electrode E1 to E10.

An annular wire 51 is provided as an anode in the nozzle 15. The positive terminal of an electrode 16 is connected to the wire 51, and the negative terminal is connected to the ammeter 52.

In the plating process, electric currents flowing through the electrodes E1 to E10 are measured by the ammeter 52 at one time. The base material 1 and the electrodes E1 to E10 are electrically connected to one another by the formation of a plated layer on the base material 1. Accordingly, electric current values in the electrodes E1 to E10 are measured while the insulation between the base material 1 and the electrodes E1 to E10 is maintained. Current densities i are calculated by dividing the current values by the surface areas of the electrodes E1 to E10, respectively.

Figure 4:
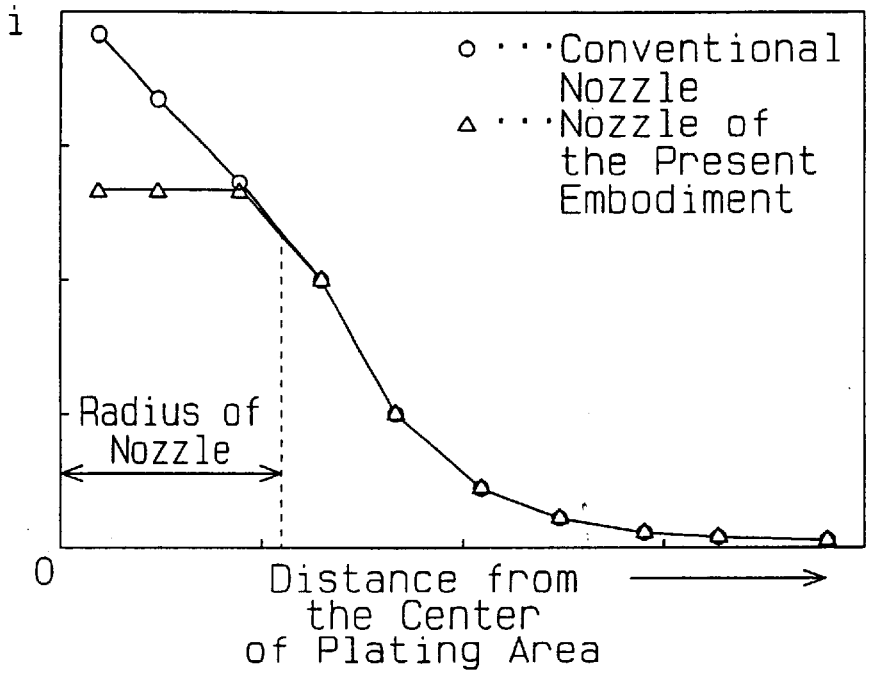
FIG. 4 is a graph showing distributions of current density relative to distances from the center of the plating area.

As shown in FIG. 4, when a conventional nozzle is used, current densities i are higher in the central region of the nozzle. In comparison, current densities i under the improved nozzle 15 are almost equal. This shows that the flow velocity at the central region of the stream in the present embodiment is lower than that of a conventional nozzle. As a result, the flow velocity of the plating fluid is more uniform.

Second Experiment: Movement of electrons in electroplating is determined by movement of metal ions in electrolytic solution. In this experiment, the material movement velocity $K_L$ was studied. The material movement velocity $K_L$ is expressed by the following expression (1). A distribution of the material movement velocity $K_L$ is calculated from measured values of the limiting current density $i_L$. The material movement velocity $K_L$ is also proportional to the flow velocity of the plating fluid.

$$K_L = i_L / z \cdot F \cdot C_0 \quad (1)$$

Figure 5:
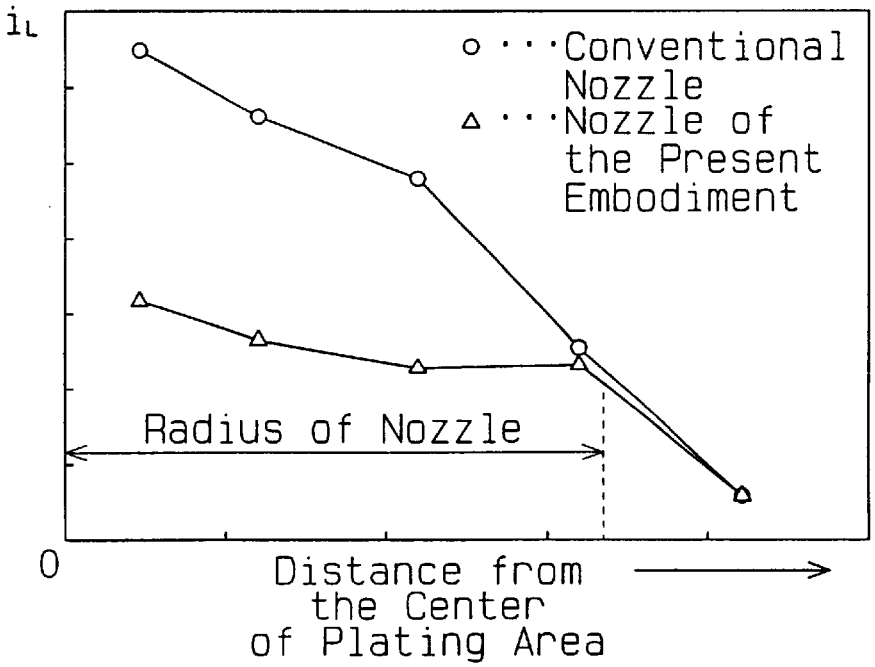
FIG. 5 is a graph showing a distribution of limiting current density relative to distances from the center the plating area.

In the expression, z is the valence, F is Faraday's constant, and $C_0$ is the ion density in electrolytic solution. The higher the limiting current density $i_L$ is, the higher the material movement velocity $K_L$ is, and the higher the number of ions supplied to the cathode. A distribution of the limiting current density $i_L$ was measured to measure a distribution of the material movement velocity $K_L$. FIG. 5 shows a distribution of the limiting current density $i_L$, which was measured for the same two kinds of nozzles in the first experiment (the conventional one and the improved one of the present embodiment).

As shown in FIG. 5, the limiting current density $i_L$ is higher near the center of the conventional nozzle, but the distribution of the limiting current density $i_L$ is almost uniform across the plating area beneath the jet nozzle 15 of the present embodiment. This shows that ion movement velocity is almost uniform across the plating area, or across an area that is a projection of the jet nozzle 15. As a result, a nearly uniform plated layer 2 is formed.

Second Embodiment

Figure 6:
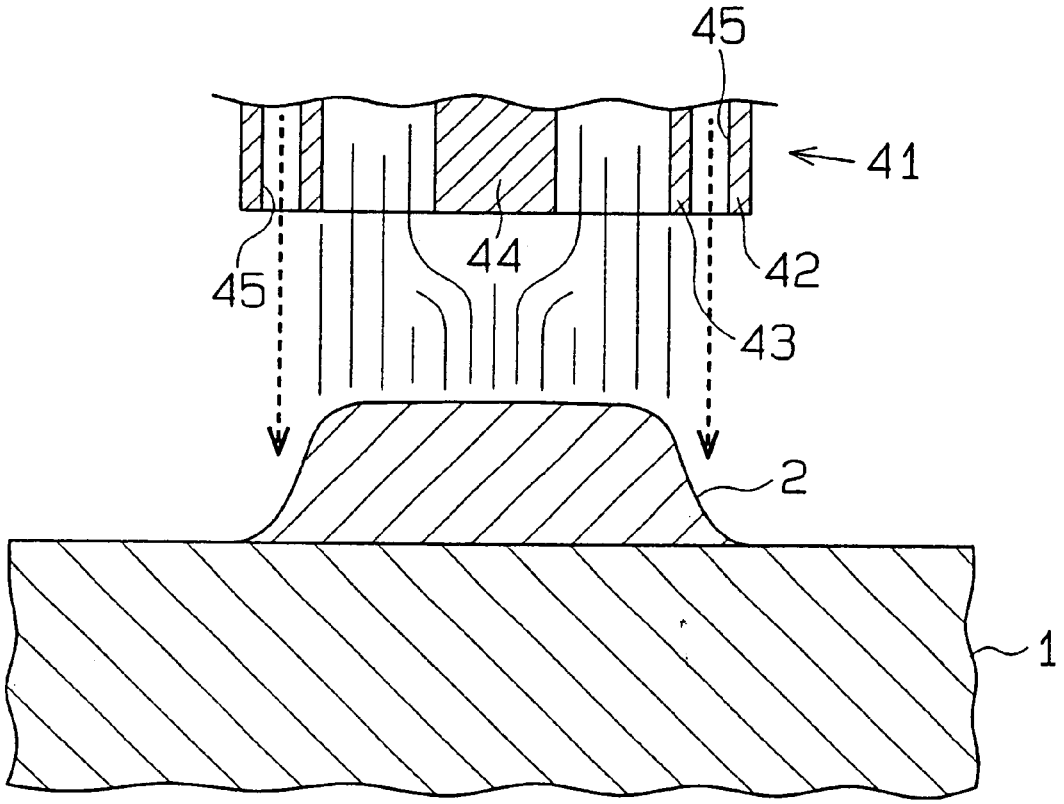
FIG. 6 is a partial sectional view showing a base material, a plated surface layer, and a jet nozzle in a second embodiment according to the present invention.

A second embodiment of the present invention will now be described in reference to FIG. 6. As shown in FIG. 6, the distal end of a jet nozzle 41 in the second embodiment includes an outer tube, or cylindrical wall 42, an inner tube or wall 43, and a stem 44. The nozzle 41 delivers plating fluid between the inner wall 43 and the stem 44. A conduit or air passage 45, is formed between the outer wall 42 and the inner wall 43. The plating apparatus of the second embodiment has an air pump (not shown) to issue air. The air from the pump is issued through the air passage 45. In the present embodiment, for example, the inner diameter of the inner tube 43 is set at 14.5 mm, the diameter of the stem 44 is set at 5.0 mm, and the inner diameter of the outer tube 42 is set at 17.5 mm.

According to the second embodiment, the flow of the plating fluid from the inner tube 43 of the jet nozzle 41 is increased by the air flow from the air passage 45. Because of this, the difference in flow velocity of plating fluid between the central region and the peripheral region of the plated surface of the base material 1 is minimized, and the flow velocity becomes more uniform. This makes the thickness of a plated layer 2 more uniform. The optimum flow velocity of air is determined in accordance with the flow velocity of the plating fluid. For example, if the flow velocity of the plating fluid is 1 m/s, the flow velocity of the air is optimum at 60 m/s. Since the flow velocity of the plating fluid is preferably 1 m/s or higher, the flow velocity of air is also preferably 60 m/s or higher.

The discharged air strikes the base material 1 and isolates the surface of the plated layer 2 from the unplated surface. As a result, the plated layer 2 is formed on the area directly under the inner tube 43 of the jet nozzle 41, and the border between the plated surface and non-plated surface becomes more distinct. This makes the outer edge of the plated layer visually pleasing.

Figure 7:
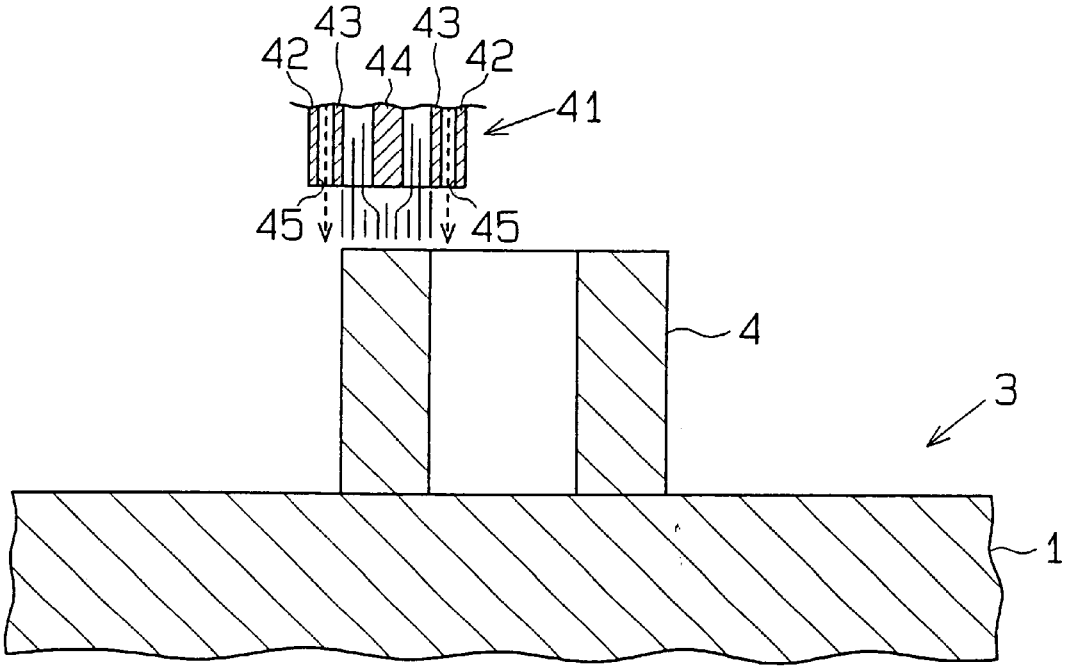
FIG. 7 is a partial sectional view of a base material, a plated surface layer, and a jet nozzle showing a method for manufacturing three-dimensional objects.
Figure 8:
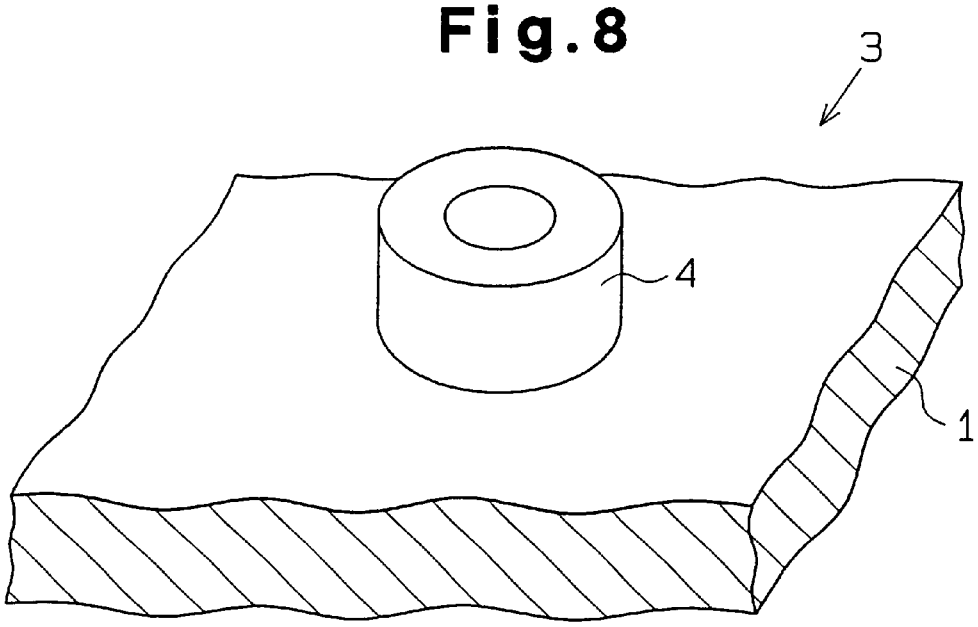
FIG. 8 is a perspective view of a manufactured mold.

A method for manufacturing three-dimensional objects will now be described. As shown in FIGS. 7 and 8, a three-dimensional object, or mold 3, includes a nickel base material 1 and a plated layer 4 made of nickel and formed on the base material 1. The plated layer 4 forms a cylindrical boss that projects upward from the base material 1.

The plating fluid is uniformly deposited on the base material with uniform flow velocity to form a cylindrical plated layer 4. The plated layer 4 is formed gradually at the locations where the plating fluid is delivered. The jet nozzle 45 is moved while forming the plated layer 4 as described. That is, the jet nozzle 45 is moved as if drawing a circle to obtain the desired shape. The plated layer 4 gradually piles up along the path of the nozzle 14, while the plated layer piles up, the nozzle 45 moves to keep a certain distance between the plated layer 4 and the distal end of the nozzle 45. In this way, a cylindrical plated layer 4 with a certain height is formed, and a mold 3 is finally obtained. Thus, three-dimensional objects of various shapes may be obtained by plating with controlled movement of the nozzle 45.

Cutting is unnecessary since the plated layer 4 is piled up on the base material 1. Accordingly, there is no waste of metals from the cutting process. Since the plating fluid squirted from the jet nozzle 14 is also recycled, the material for the mold 3 is efficiently used.

Since the thickness of the plated layer 4 is controlled at the micron order by controlling plating time, grinding can be omitted in some cases. As a result, efficiency in manufacturing molds improves significantly.

Large scale equipment is not necessary since required shapes of plated layers 4 are obtained simply by the movement of the nozzle 45 during plating process. The manufacturing cost is also lowered.

Figure 9:
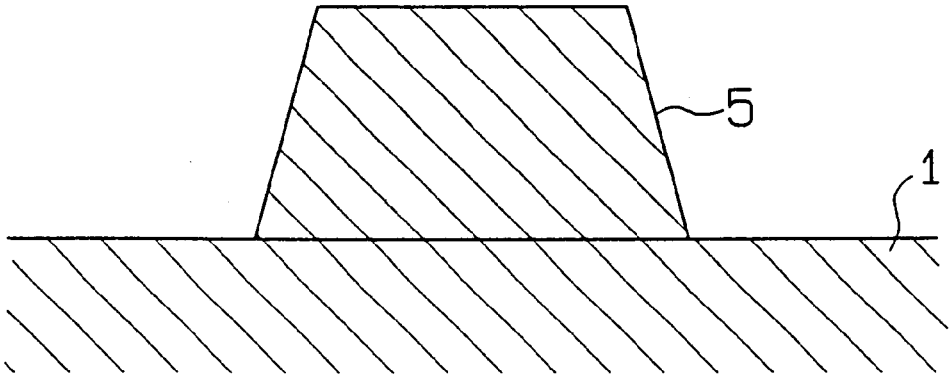
FIG. 9 is a sectional view of another plated layer on a base material.
Figure 10:
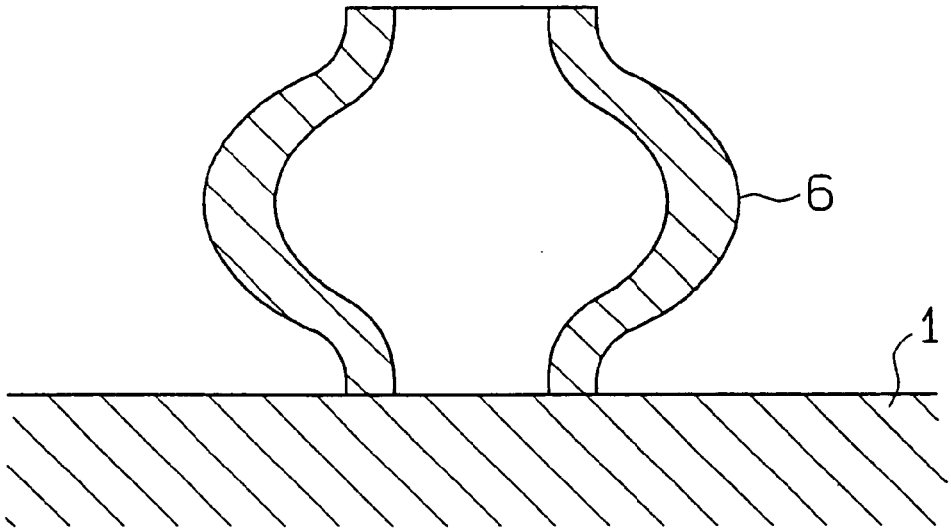
FIG. 10 is a sectional view of still another plated layer on a base material.

Many shapes of plated layers may be formed by moving the jet nozzle 45. For example, as shown in FIG. 9, a plated layer 5 shaped like a truncated conical platform may also be formed. To manufacture undercut shapes, a plated layer 6 shown in FIG. 10 may also be formed. Though not shown in the drawings, hollow three-dimensional objects, which were hard to manufacture with conventional technologies, may also be manufactured by accumulating a plated layer to close the opening.

Besides molds, the method in the present invention may be used for manufacturing samples of molded parts, bronze ornaments, and printing plates made of metal.

To move the jet nozzle 45 and the base material 1 relative to each other, the nozzle 45 may be fixed and the base material 1 may be moved. The jet nozzle may be tilted in accordance with requirements.

It should be apparent to those skilled in the art that the present invention may be embodied in many other specific forms without departing from the spirit or scope of the invention. Particularly, it should be understood that the invention may be embodied in the following forms.

(1) Insoluble particles may be mixed in the plating fluid. When the plating fluid is squirted on the base material 1, the force of the collision of insoluble particles acts on the surface of the base material 1. The collision of insoluble particles scrapes off the oxide films that may have been formed during a plating process. Accordingly, the pretreating stage that removes the oxide films may be omitted.

When the insoluble particles are mixed in the plating fluid, co-deposits of the insoluble particles are formed in the plated layer 2 by relatively lowering the flow velocity. The co-deposits of insoluble particles improve the hardness of the plated layer 2.

Oxides such as alumina, zirconia, silica, titania, ceria, complex oxides formed by two or more of these oxides, carbides such as silicon carbide or titan carbide, nitrides such as silicon nitride or boron nitride, and organic polymeric powders such as fluororesin powder, polyamid powder, polyethylene powder are suitable as insoluble particles. Any kind of insoluble particles may be employed, as long as they are insoluble and dispersible in the plating fluid and have a required hardness. The insoluble particle diameters are preferably within the range from 0.1 $\mu$m to 1000 $\mu$m. The density (dispersed amount) of insoluble particles dispersed in the plating fluid may be chosen according to need, but is preferably within the range from 1 g/L to 1000 g/L, and more preferably from 10 to 500 g/L.

(2) The cross (as viewed axially) section of the nozzles 15, 41 in each embodiment may be non-circular.

(3) Metals other than nickel may be employed to form the plated layer 2 in each embodiment.

(4) The base material 1 may be any conductive metal.

(5) In the second embodiment, the air passage between the outer cylinder 42 and the inner cylinder 43 is annular to deliver jet air, but it may be shaped other than annularly. The speed of the plating fluid squirted from the periphery of the nozzle 41 is increased by the air. Accordingly, even if the stem 44 is omitted, flow velocity of the plating fluid becomes more uniform compared with that of conventional nozzles. Other gases such as nitrogen and argon may also be used instead of air.

(6) Only one jet nozzle 15 or 41 is used in each embodiment for the convenience of description, but more than one nozzle may be used in each embodiment.

Therefore, the present examples and embodiments are to be considered as illustrative and not restrictive and the invention is not to be limited to the details given herein, but may be modified within the scope and equivalence of the appended claims.

What is claimed is:

1. A plating method comprising:

providing a conductive base material;

exposing a surface of the base material to the atmosphere;

depositing a stream of plating fluid onto the exposed surface of the base material from a nozzle positioned over the base material such that the plating fluid has a substantially uniform flow velocity across the stream when the plating fluid contacts the base material, wherein the depositing comprises delivering the stream from a peripheral portion of the nozzle while obstructing the center of the nozzle, wherein the nozzle has an annular opening and a passage connected to the annular opening, and a predetermined length of the passage has an annular cross-section; and applying a voltage between the nozzle and the base material to form a layer of plating on the surface of the base material.

2. The plating method according to claim 1, further comprising the step of increasing the velocity of the periphery of the stream.

3. The plating method according to claim 2, wherein the increasing step is a step of flowing gas toward the base material from a conduit that surrounds the nozzle.

4. The plating method according to claim 1, further comprising the step of adding insoluble particles to the stream.

5. An apparatus for forming a layer of plating on a conductive base material exposed to atmosphere, the plating apparatus comprising:

a nozzle positioned over the exposed base material, said nozzle depositing a substantially uniform flow velocity stream of plating fluid on the base material when the plating fluid contacts the base material, wherein the nozzle has an annular opening, said opening obstructed at a central region thereof, the nozzle further comprising a passage connected to the annular opening, and a predetermined length of the passage has an annular cross section, wherein the nozzle has a tube;

a stem located substantially at the center of the tube, wherein the tube and the stem of the nozzle define an annular opening therebetween; and a voltage source creating a voltage between the base material and the nozzle.

6. The plating apparatus according to claim 5, further comprising means for increasing the velocity of a peripheral portion of the stream.

7. The plating apparatus according to claim 5, wherein the nozzle includes an outer pipe surrounding the tube, wherein the tube and the pipe define a conduit therebetween, and wherein gas is issued from the conduit to increase the velocity of the peripheral portion of the stream.

8. The plating apparatus according to claim 5, wherein the stream includes insoluble particles for striking the surface of the base material.

9. The plating apparatus according to claim 7, wherein the outer pipe and the tube are cylindrical.

10. A method for manufacturing a three dimensional object, the method comprising:

providing a conductive base material;

depositing a stream of plating fluid onto the base material from a nozzle positioned over the base material at a controlled flow velocity, wherein the flow velocity of the plating fluid is substantially uniform across the stream when the plating fluid contacts the base material and the depositing is performed in atmosphere, wherein the depositing comprises delivering the stream from a peripheral portion of the nozzle while obstructing the center of the nozzle, wherein the nozzle has an annular opening and a passage connected to the annular opening, and a predetermined length of the passage has an annular cross-section;

forming a plating layer on the surface of the base material by applying a voltage between the nozzle and the base material; and forming a three dimensional object with a desired shape by controlling movement of the nozzle with respect to the base material and adding layers.

11. The method according to claim 10, wherein the nozzle moves.

12. The method according to claim 10, further comprising the step of increasing the velocity of the periphery of the stream.

13. The plating method according to claim 12, wherein the increasing step is a step of flowing gas toward the base material from a conduit that surrounds the nozzle.

14. The plating method according to claim 10, further comprising the step of adding insoluble particles to the stream.

15. The method according to claim 10, wherein the base material moves.

* * * * *

UNITED STATES PATENT AND TRADEMARK OFFICE

CERTIFICATE OF CORRECTION

PATENT NO. : 6,221,230 B1
APPLICATION NO. : 09/078572
DATED : April 24, 2001
INVENTOR(S) : Takeuchi et al.

It is certified that error appears in the above-identified patent and that said Letters Patent is hereby corrected as shown below:

Title Page, Insert

--[73] Assignee: Toyoda Gosei Co., Ltd., Japan--

Signed and Sealed this

Eighth Day of December, 2009

David J. Kappos

David J. Kappos
*Director of the United States Patent and Trademark Office*